US010822927B2

(12) United States Patent
Tang et al.

(10) Patent No.: US 10,822,927 B2
(45) Date of Patent: Nov. 3, 2020

(54) DEVICE AND METHOD FOR SOLID-STATE FLUIDIZED MINING OF NATURAL GAS HYDRATES IN SHALLOW SEABED

(71) Applicant: SOUTHWEST PETROLEUM UNIVERSITY, Sichuan (CN)

(72) Inventors: Yang Tang, Sichuan (CN); Guorong Wang, Sichuan (CN); Shouwei Zhou, Sichuan (CN); Qingyou Liu, Sichuan (CN); Lin Zhong, Sichuan (CN); Wang Li, Sichuan (CN); Qingping Li, Sichuan (CN); Qiang Fu, Sichuan (CN); Yufa He, Sichuan (CN); Chuan Wang, Sichuan (CN); Leizhen Wang, Sichuan (CN)

(73) Assignee: SOUTHWEST PETROLEUM UNIVERSITY, Chengdu (CN)

( * ) Notice: Subject to any disclaimer, the term of this patent is extended or adjusted under 35 U.S.C. 154(b) by 0 days.

(21) Appl. No.: 16/601,562

(22) Filed: Oct. 14, 2019

(65) Prior Publication Data

US 2020/0040710 A1 Feb. 6, 2020

Related U.S. Application Data

(63) Continuation of application No. PCT/CN2018/085796, filed on May 7, 2018.

(30) Foreign Application Priority Data

Apr. 24, 2018 (CN) ..... 2018 1 0373892

(51) Int. Cl.
*E21B 7/04* (2006.01)
*E21B 7/128* (2006.01)
(Continued)

(52) U.S. Cl.
CPC ..... *E21B 43/01* (2013.01); *E21B 7/043* (2013.01); *E21B 7/128* (2013.01); *E21B 17/18* (2013.01); *E21B 43/36* (2013.01); *E21B 41/0099* (2020.05)

(58) Field of Classification Search
CPC ..... E21B 7/043; E21B 7/128; E21B 17/18; E21B 41/0099; E21B 43/01; E21B 43/36
See application file for complete search history.

(56) References Cited

U.S. PATENT DOCUMENTS 5,076,364 A 12/1991 Hale et al.
6,148,911 A 11/2000 Gipson et al.
(Continued)

FOREIGN PATENT DOCUMENTS

CN 105545257 A 5/2016
CN 107448176 A 12/2017
(Continued)

*Primary Examiner* — Matthew R Buck
(74) *Attorney, Agent, or Firm* — Wayne & Ken, LLC; Tony Hom

(57) ABSTRACT

Disclosed is a device for solid-state fluidized mining of natural gas hydrates in a shallow seabed, including: a sea surface support system, a pipeline delivery system, and an undersea drilling system. The sea surface support system includes a hydrate drilling vessel floating on seawater. The pipeline delivery system includes a continuous double-layer oil pipe, a recyclable conduit installed in a sediment cover, an open-hole steering packer installed outside the recyclable conduit. The undersea drilling system includes a hydrate slurry separator, a single screw pump, a hydraulic motor, a jet head and a differential pressure sliding sleeve close to the hydrate drill bit. The present invention has the following beneficial effects. The device achieves a multi-directionally horizontal drilling and production in the hydrate reservoir with a single well head, improving the drilling efficiency and single well production.

4 Claims, 7 Drawing Sheets

(51) Int. Cl.

| | |
|---|---|
| ***E21B 17/18*** | (2006.01) |
| ***E21B 43/01*** | (2006.01) |
| ***E21B 43/36*** | (2006.01) |
| *E21B 41/00* | (2006.01) |

(56) References Cited

U.S. PATENT DOCUMENTS

| | | | | |
|---|---|---|---|---|
| 2004/0104052 | A1* | 6/2004 | Livingstone | E21B 21/12<br>175/61 |
| 2005/0103527 | A1* | 5/2005 | Church | E21B 7/068<br>175/62 |

FOREIGN PATENT DOCUMENTS

| | | | | | |
|---|---|---|---|---|---|
| CN | 107503714 | A | | 12/2017 | |
| CN | 107642346 | A | | 1/2018 | |
| CN | 109763776 | A | | 5/2019 | |
| JP | 2003193787 | A | * | 7/2003 | E21B 41/0099 |
| JP | 2003193788 | A | * | 7/2003 | E21B 41/0099 |

* cited by examiner

DEVICE AND METHOD FOR SOLID-STATE FLUIDIZED MINING OF NATURAL GAS HYDRATES IN SHALLOW SEABED

CROSS-REFERENCE TO RELATED APPLICATIONS

This application is a continuation of International Application No. PCT/CN2018/085796 with a filling date of May 7, 2018, designating the United States, now pending, and further claims to the benefit of priority from Chinese Application No. 201810373892.8 with a filing Date of Apr. 24, 2018. The content of the rarely applications, including any intervening amendments is, incorporated by reference.

TECHNICAL FIELD

This application relates to natural gas hydrate mining, particularly to a device and method for the solid-state fluidized mining of natural gas hydrates in a shallow seabed.

BACKGROUND OF THE INVENTION

In the seabed, natural gas hydrates mainly exist in the forms of sandstone, fractured sandstone, fractured fine particle or in a dispersing form, of which the fractured fine particle and dispersing hydrates account for the majority. However, such hydrates are buried shallowly and have a poor cementing property, so geological and environmental disasters are easy to be caused during the mining. In recent years, researches on test mining of marine natural gas hydrate have been made successively in Japan and China, mainly via heat injecting, pressure reducing, etc., which are all based on traditional oil and gas exploitation. However, these methods can only achieve short-term test mining rather than continuously long-term mining for natural gas hydrates, even for those natural gas hydrate reservoirs with high saturation and stable sediment covers. Moreover, potential environmental and geological disasters may be caused.

The solid-state fluidized mining provides a novel idea for mining natural gas hydrates in the seabed, in which machines are directly adopted for mining natural gas hydrates ore body without changing the seabed temperature and pressure, and a mixture of seawater and broken solid particles of natural gas hydrates is pumped to the sea surface via a sealed pipeline. The solid-state fluidized mining is divided into two types according to different buried depths of the hydrate reservoirs, which are surface solid-state fluidized mining and shallow solid-state fluidized mining. For the surface solid-state fluidized mining, a seabed mining device exploits and breaks the hydrate ore body in the seabed during moving. However, the seabed mining device is required to remove the mud layer of tens or even one or two hundred meters on the hydrate ore body before exploiting the hydrate ore body in the shallow hydrate reservoirs, which greatly increases the additional engineering work and the cost of commercial hydrate mining. Currently, the main idea of the solid-state fluidized mining for shallow hydrates is to adopt methods such as water jetting, mechanical agitation and suction to break the hydrates and expand the borehole based on the traditional horizontal drilling technique for oil and gas mining, thereby mining the hydrate ore body in the shallow seabed in an economical and effective way. However, the solid-state fluidized mining for the shallow hydrates is still in a conceptual stage, and no systematical and practicable process or equipment has been formed now. For example, Chinese Patent Application Publication No. CN 109763776 A discloses a double-layer tube connected with a two-way bridge joint for the solid mining of natural gas hydrates; Chinese Patent Application Publication No. CN 107503714 A discloses a parallel device for in-situ separating natural gas hydrates in the shallow seabed. There are still many problems to be solved. For example, when the sediment cover and the hydrate reservoir are both shallow, it is hard to drill horizontally for a long distance. During the hydrate mining process, an in-situ separation of the hydrate and the sediment and an efficient breaking for the hydrates need to be achieved. After the in-situ separation, a backfilling and a settlement of the sediment is not effective enough. Additionally, the mined areas underground may be excessively large to cause accidentally serious stratum collapses. To achieve a commercial exploitation, it is necessary to reduce the hydrate mining cost and the mining frequency and to improve the mining efficiency. For a green mining, devices in the seabed well head should be recyclable to reduce waste well heads.

SUMMARY OF THE INVENTION

To overcome the shortcomings of the prior art, an object of the present invention is to provide a device and method for solid-state fluidized mining of natural gas hydrates in a shallow seabed, achieving a multi-directionally horizontal drilling and production in the hydrate reservoir with a single well head, which improves the drilling efficiency and single well production. A hydrate slurry is separated in-situ, and a sediment is backfilled and settled naturally, reducing the risk of collapses in the goaf. The device in the seabed well head is recyclable, allowing a more efficient back-pulling and ejection of a pilot hole in the natural gas hydrates in the shallow seabed for a green mining. The invention effectively solves the technical problems in solid-state fluidized mining of natural gas hydrates in the shallow seabed.

The invention provides a device for solid-state fluidized mining of natural gas hydrates in a shallow seabed, including:

a sea surface support system, a pipeline delivery system, and an undersea drilling system.

The sea surface support system includes a hydrate drilling vessel floating on seawater, a hydrate storage tank, a high-pressure pump set and a continuous double-layer oil pipe storage device arranged on the hydrate drilling vessel.

The pipeline delivery system includes a continuous double-layer oil pipe, a recyclable conduit installed in a sediment cover, an open-hole steering packer installed outside the recyclable conduit. The continuous double-layer oil pipe penetrates the recyclable conduit. A head end of the continuous double-layer oil pipe is fixed on the continuous double-layer oil pipe storage device, where an inner channel of the continuous double-layer oil pipe is connected to the hydrate storage tank, and an outer channel of the continuous double-layer oil pipe is connected to an outlet port of the high-pressure pump set; and a tail end of the continuous double-layer oil pipe is connected to the undersea drilling system in the hydrate reservoir.

The undersea drilling system includes a hydrate slurry separator, a first three-layer tube, an internal and external fluid exchange joint of double-layer tube and a second three-layer tube, connected successively. Via the hydrate slurry separator, the outer channel of the continuous double-layer oil pipe communicates with a middle channel of the first three-layer tube, while the inner channel of the continuous double-layer oil pipe communicates with an inner channel of the first three-layer tube. A bottom channel of the hydrate slurry separator is in communication with an outer channel of the first three-layer tube. Via the internal and external fluid exchange joint of double-layer tube, the middle channel of the first three-layer tube communicates with an inner channel of the second three-layer tube, while the inner channel of the first three-layer tube communicates with a middle channel of the second three-layer tube. The outer channel of the first three-layer tube communicates with an outer channel of the second three-layer tube. A jet head is arranged in an end of the inner channel of the second three-layer tube. The jet head is connected to the second three-layer tube, and is equipped with a pressure differential sliding sleeve. A hydrate drill bit is fixed at an end of the jet head, and is provided with a seawater ejecting-drilling channel along an axial direction of the hydrate drill bit. The seawater ejecting-drilling channel communicates with the jet head.

A single screw pump is fixed in the inner channel of the first three-layer tube, and a hydraulic motor is fixed in the inner channel of the second three-layer tube. Via a coupling penetrating the internal and external fluid exchange joint of double-layer tube, one end of an output shaft of the hydraulic motor connects to an input shaft of the single screw pump, the other end of an output shaft of the hydraulic motor is fixedly connected to the jet head. A sediment backfilling casing is sheathed outside the undersea drilling system; one end of the sediment backfilling casing is connected to a sediment outlet of the hydrate slurry separator, and the other end of the sediment backfilling casing is arranged with a sediment backfilling channel. A plurality of jet holes communicating with the jet head are provided on a cylindrical surface of the sediment backfilling casing along a circumferential direction of the sediment backfilling casing, and a return port communicating with the outer channel of the second three-layer tube is further provided on the cylindrical surface of the sediment backfilling casing.

A derrick is further provided on the hydrate drilling vessel.

A jet head of continuous double-layer oil pipe is provided on the derrick.

A mining method using the device for solid-state fluidized mining of natural gas hydrates in the shallow seabed, including:

1) drilling 1a) driving the hydrate drilling vessel to a hydrate collection site and anchoring the hydrate drilling vessel;

1b) lowering the continuous double-layer oil pipe and the recyclable conduit down to a seabed;

1c) drilling into the sediment cover:

opening the high-pressure pump set and pumping the seawater into the outer channel of the continuous double-layer oil pipe; ejecting the seawater with pressure from the drilling channel of the hydrate drill bit to the sediment cover by successively passing through the hydrate slurry separator, the middle channel of the first three-layer tube, the internal and external fluid exchange joint of double-layer tube, the inner channel of the second three-layer tube, the hydraulic motor and an inner cavity of the jet head; at the same time, when the high-pressure seawater is injected into the hydraulic motor, driving the output shaft of the hydraulic motor to rotate to drive the input shaft of the single screw pump through the coupling to rotate, while driving the jet head to rotate to drive the hydrate drill bit to rotate, so that the hydrate drill bit drills into the hydrate reservoir, drilling into the hydrate cover by injecting the high-pressure seawater and rotating the hydrate drill bit;

1d) fixing the open-hole steering packer in a well drilled in step 1c, and installing the recyclable conduit in the open-hole steering packer;

1e) releasing the continuous double-layer oil pipe to disengage from the recyclable conduit, wherein the continuous double-layer oil pipe continues to drill;

1f) adjustment of drilling angle:

during the drilling of the continuous double-layer oil pipe in the hydrate reservoir, adjusting the drilling angle of the continuous double-layer oil pipe via a deflecting technique, where the recyclable conduit rotates around the open-hole steering packer to assist a deflection of the drilling of the continuous double-layer oil pipe according to a drilling direction in the hydrate reservoir, that is, to increase a deflecting angle of the continuous double-layer oil pipe to ensure an effective drilling length of the continuous double-layer oil pipe in a horizontal direction in the hydrate reservoir which is shallow;

1g) resetting the pressure differential sliding sleeve:

reducing the pressure of the high-pressure pump set for pumping the seawater to allow a pressure of the pumped seawater to be lower than a pressure of the seawater from the drilling channel, so that the pressure differential sliding sleeve is in an inner end of the jet head to close the jet holes;

1h) driving the hydrate drill bit to continue to drill in a horizontal direction till a pilot hole is completed;

2) exploiting the natural gas hydrates, including:

2a) opening the pressure differential sliding sleeve:

increasing the pressure of high-pressure pump set for pumping the seawater to allow the pressure of the pumped seawater in the jet head to be higher than the pressure of the seawater from the drilling channel, so that the pressure differential sliding sleeve is forced to move forward to block the drilling channel and to open the jet holes;

2b) circumferential breaking:

ejecting the high-pressure seawater from the jet holes; breaking the hydrate reservoir in a circumferential direction of the pilot hole to expand the pilot hole in a circumferential direction of the pilot hole, obtaining a hydrate sediment mixing slurry;

2c) pulling back the continuous double-layer oil pipe:

pulling back the continuous double-layer oil pipe to break the hydrate reservoir along an axial direction of the pilot hole; and gradually expanding a borehole along an opposite direction of the drilling with a flow of the high-pressure seawater ejected from the jet head;

2d) driving the single screw pump by the hydraulic motor to allow the hydrate sediment mixing slurry to flow successively through the return port, the middle channel of the second three-layer tube, the internal and external fluid exchange joint of double-layer tube, and the inner channel of the first three-layer tube into the hydrate slurry separator for separation;

where a separated hydrate is collected into the hydrate storage tank via the inner channel of the continuous double-layer oil pipe; a separated sediment is discharged into the sediment backfill casing via the sediment outlet, and finally into a mined area via the sediment backfilling channel;

2e) changing a direction to drill the pilot hole:

after the pulling back, adjusting the recyclable conduit to rotate around the open-hole steering packer according to the drilling direction; adjusting the deflecting angle again to increase a deflecting rate; drilling a second pilot hole according to the drilling process;

2f) repeating steps 2a-d to exploit the natural gas hydrate at a second site;

2e) repeating steps 1-2 to exploit the natural gas hydrate around the hydrate collection site;

3) recycle of the device 3a) pulling back the continuous double-layer oil pipe to a seafloor mud line;

3b) re-hanging the recyclable conduit to the continuous double-layer oil pipe using an underwater robot;

3c) unsealing the open-hole steering packer to release the recyclable conduit;

3d) lifting the recyclable conduit and the continuous double-layer oil pipe up to the hydrate drilling vessel; and 3e) moving the hydrate drilling vessel to drill the natural gas hydrate at a next hydrate collection site.

The present invention has the following beneficial effects.

(1) The device achieves a multi-directionally horizontal drilling and production of the hydrate reservoir in the shallow seabed, with a single well head, a single tube and in one-time completion, improving the drilling efficiency and single well production.

(2) After the single screw pump is driven by the hydraulic motor, the hydrate sediment mixing slurry flows successively through the return port, the middle channel of the second three-layer tube, the internal and external fluid exchange joint of double-layer tube, the inner channel of the first three-layer tube and then into the hydrate slurry separator for separation. A hydrate is collected into the hydrate storage tank via the inner channel of the continuous double-layer oil pipe. The sediment is discharged into the sediment backfill casing via the sediment outlet, and finally into a mined area via the sediment backfilling channel. The hydrate and sediment are separated in-situ, the sediment is backfilled effectively and settled naturally, reducing the risk of collapses in the goaf, effectively overcoming technical problems of solid-state fluidized mining of hydrates in the shallow seabed.

(3) The device is recyclable. The underwater robot re-hangs the recyclable conduit to the continuous double-layer oil pipe and the open-hole steering packer is unsealed to release the recyclable conduit. The recyclable conduit and the continuous double-layer oil pipe are lifted up to the hydrate drilling vessel. Then, the hydrate drilling vessel is moved to drill the natural gas hydrate at a next hydrate collection site. Therefore, the device in the seabed well head is recyclable, reducing costs for equipment and guaranteeing the mining for hydrates.

Figure 1:
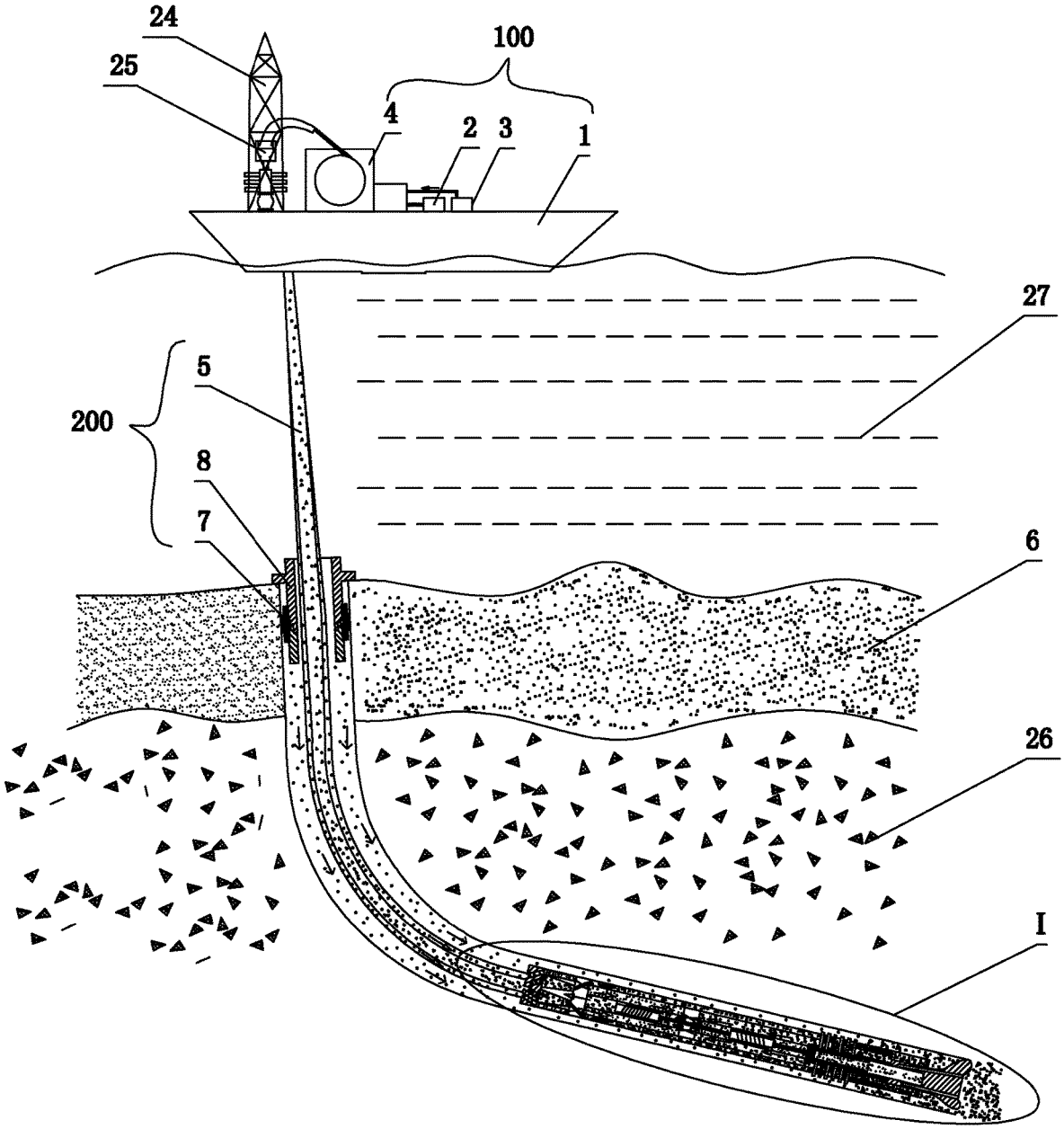
FIG. 1 is a schematic diagram showing a drilling process according to an embodiment of the invention.
Figure 2:
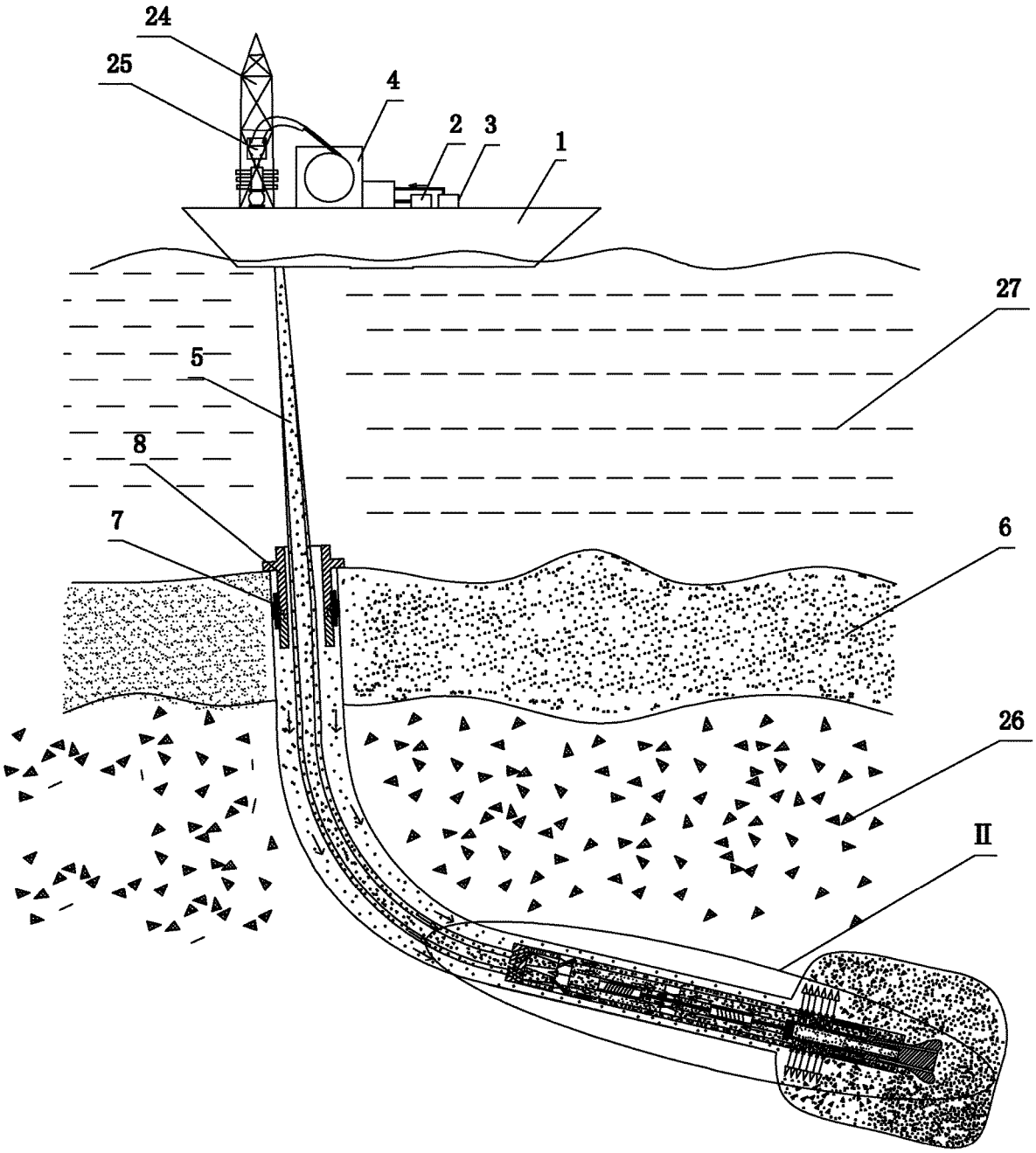
FIG. 2 is a schematic diagram showing a pulling back process according to an embodiment of the invention.
Figure 3:
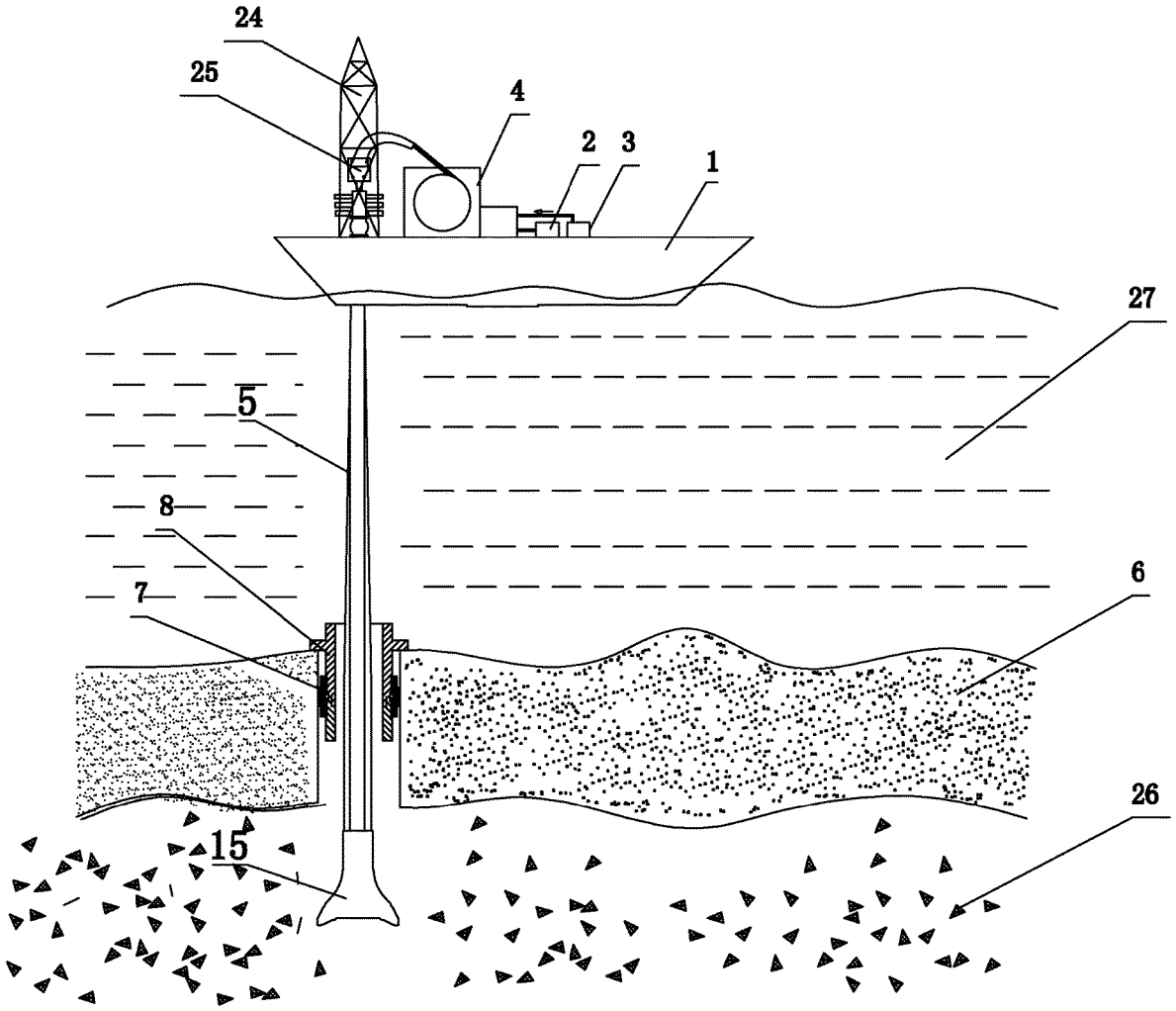
FIG. 3 is a schematic diagram showing a recycling process according to an embodiment of the invention.
Figure 4:
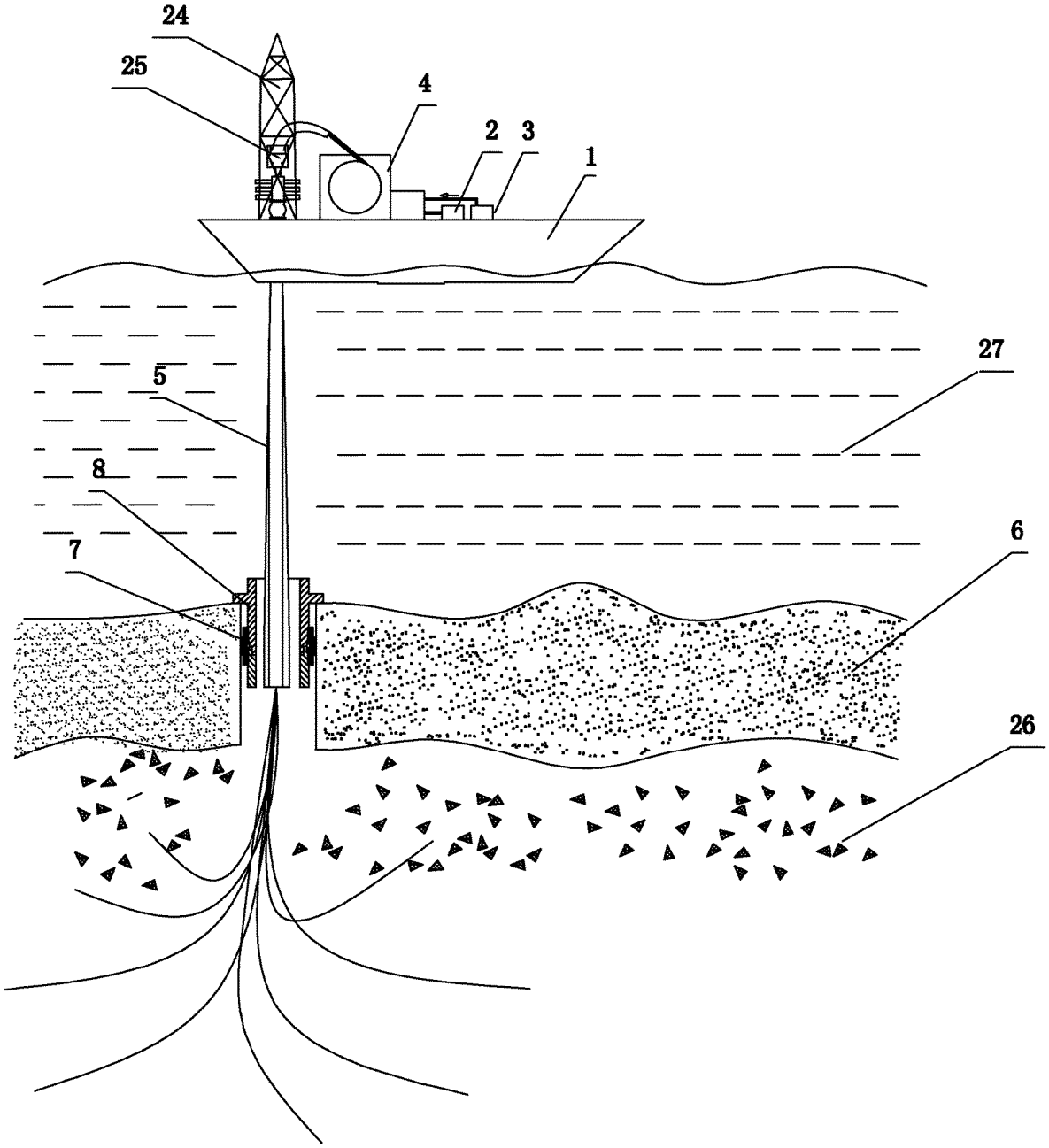
FIG. 4 is a schematic diagram showing a multi-directional drilling process according to an embodiment of the invention.

In the drawings: 100, sea surface support system; 200, pipeline delivery system; 300, undersea drilling system; 1, hydrate drilling vessel; 2, hydrate storage tank; 3, high-pressure pump set; 4, continuous double-layer oil pipe storage device; 5, continuous double-layer oil pipe; 6, sediment cover; 7, open-hole steering packer; 8, recyclable conduit; 9, hydrate slurry separator; 10, first three-layer tube; 11, internal and external fluid exchange joint of double-layer tube; 12, second three-layer tube; 13, jet head; 14, pressure differential sliding sleeve; 15, hydrate drill bit; 16, drilling channel; 17, single screw pump; 18, hydraulic motor; 19, coupling; 20, sediment backfilling casing; 21, sediment backfilling channel; 22, jet hole; 23, return port; 24, derrick; 25, jet head of continuous double-layer oil pipe; 26, hydrate reservoir; 27, seawater layer; 401, adaptor; 402, housing; 403, double-layer pipe; 404, roller shaft; 405, roller; 51, inner channel of continuous double-layer oil pipe; 52, outer channel of continuous double-layer oil pipe; 901, sediment outlet; 902, bottom channel; 101, middle channel of first three-layer tube; 102, inner channel of first three-layer tube; 103, outer channel of first three-layer tube; 121, middle channel of second three-layer tube; 122, inner channel of second three-layer tube; 123, outer channel of second three-layer tube; 171 output shaft; 181, input shaft.

DETAILED DESCRIPTION OF EMBODIMENTS

The present invention will be described with reference to the embodiments for a better understanding. However, the invention is not limited to the embodiments described herein.

As shown in FIGS. 1-7, a device for solid-state fluidized mining of natural gas hydrates in a shallow seabed, including:

a sea surface support system 100, a pipeline delivery system 200, and an undersea drilling system 300.

The sea surface support system 100 includes a hydrate drilling vessel 1 floating on seawater, a hydrate storage tank 2, a high-pressure pump set 3 and a continuous double-layer oil pipe storage device 4 settled on the hydrate drilling vessel 1.

The pipeline delivery system 200 includes a continuous double-layer oil pipe 5, a recyclable conduit 8 installed in a sediment cover 6, and an open-hole steering packer 7 installed outside the recyclable conduit 8. The continuous double-layer oil pipe 5 penetrates the recyclable conduit 8. A head end of the continuous double-layer oil pipe 5 is fixed on the continuous double-layer oil pipe storage device 4, where an inner channel 51 of the continuous double-layer oil pipe 5 is connected to the hydrate storage tank 2, and an outer channel 52 of the continuous double-layer oil pipe 5 is connected to an outlet port of the high-pressure pump set 3; and a tail end of the continuous double-layer oil pipe 5 is connected to the undersea drilling system 300 in the hydrate reservoir 26.

The undersea drilling system 300 includes a hydrate slurry separator 9, a first three-layer tube 10, an internal and external fluid exchange joint of double-layer tube 11, and a second three-layer tube 12, connected successively. Via the hydrate slurry separator 9, the outer channel 52 of the continuous double-layer oil pipe 5 communicates with a middle channel 101 of the first three-layer tube 10, while the inner channel 51 of the continuous double-layer oil pipe 5 communicates with an inner channel 102 of the first three-layer tube 10. A bottom channel 902 of the hydrate slurry separator 9 is in communication with an outer channel 103 of the first three-layer tube 10. Via the internal and external fluid exchange joint of double-layer tube 11, the middle channel 101 of the first three-layer tube 10 communicates with the inner channel 122 of the second three-layer tube 12, while the inner channel 102 of the first three-layer tube 10 communicates with the middle channel 121 of the second three-layer tube 12. The outer channel 103 of the first three-layer tube 10 communicates with an outer channel 123 of the second three-layer tube 12. A jet head 13 is arranged in an end of the inner channel 122 the second three-layer tube 12. The jet head 13 is connected to the second three-layer tube 12, and is equipped with a pressure differential sliding sleeve 14. A hydrate drill bit 15 is fixed at an end of the jet head 13, and is provided with a seawater ejecting-drilling channel 16 along an axial direction of the hydrate drill bit 15. The seawater ejecting-drilling channel 16 communicates with the jet head 13.

A single screw pump 17 is fixed in the inner channel 102 of the first three-layer tube 10, and a hydraulic motor 18 is fixed in the inner channel 122 of the second three-layer tube 12. Via a coupling 19 penetrating the internal and external fluid exchange joint of double-layer tube 11, one end of an output shaft 181 of the hydraulic motor 18 connects to an input shaft 171 of the single screw pump 17, and the other end of the output shaft 181 is connected to the jet head 13. A sediment backfilling casing 20 is equipped outside the undersea drilling system 300. One end of the sediment backfilling casing 20 is connected to a sediment outlet 901 of the hydrate slurry separator 9, and the other end of the sediment backfilling casing 20 is arranged with a sediment backfilling channel 21. A plurality of jet holes 22 communicating with the jet head 13 are provided on a cylindrical surface of the sediment backfilling casing 20 along a circumferential direction of the sediment backfilling casing 20, and a return port 23 communicating with the outer channel 123 of the second three-layer tube 12 is further provided on the cylindrical surface of the sediment backfilling casing 20.

A derrick 24 is further provided on the hydrate drilling vessel 1.

A jet head of continuous double-layer oil pipe 25 is provided on the derrick 24.

A mining method using the device for solid-state fluidized mining of natural gas hydrates in the shallow seabed, including the following steps.

1) Drilling

1a) The hydrate drilling vessel 1 is driven to a hydrate collection site, and the hydrate drilling vessel 1 is anchored.

1b) The continuous double-layer tube 5 and the recyclable conduit 8 are lowered down to a seabed.

1c) The device is drilled into the sediment cover 6, which includes the following steps.

The high-pressure pump set 3 is opened, and the seawater is pumped into the outer channel 52 of the continuous double-layer tube 5.

Figure 8:
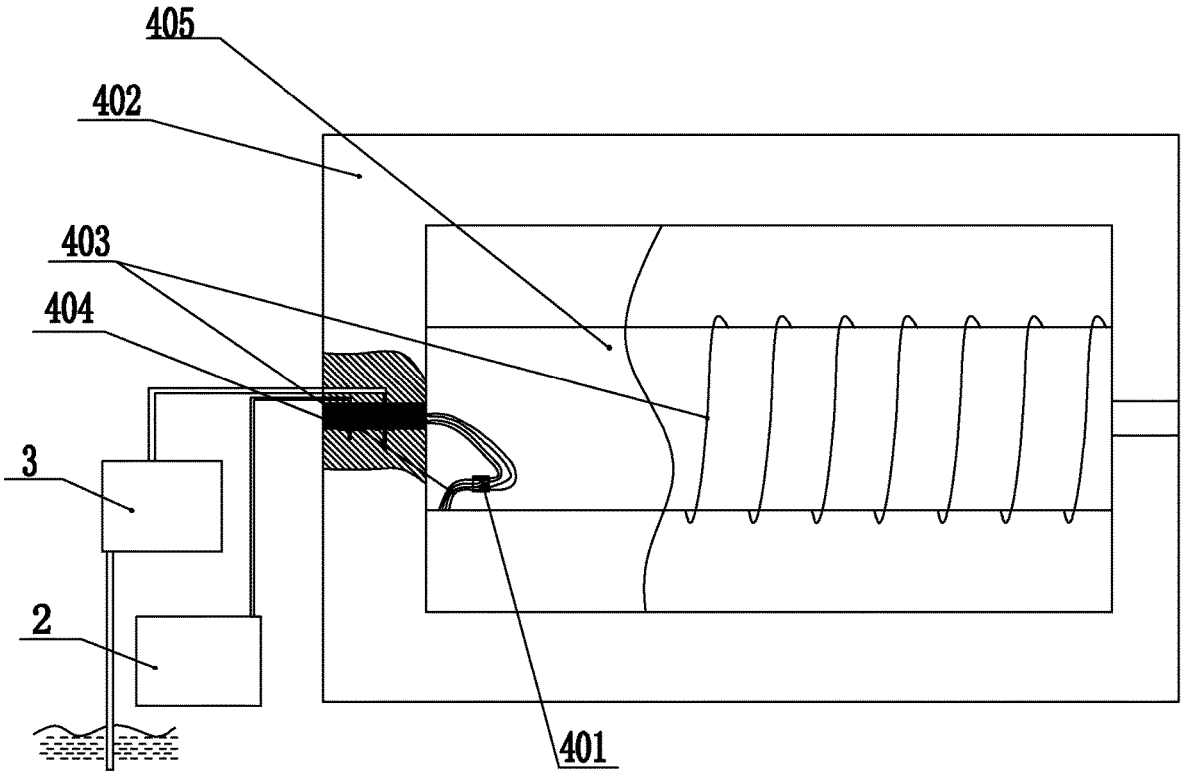
FIG. 8 shows a partial view of a sea surface support system according to an embodiment of this invention.

As shown in FIG. 8, a roller 405 of the continuous double-layer oil pipe storage device 4 rotates in a housing 402 via a shaft at both ends of the roller, and the double-layer tube 403 is winded around the roller 405. The double-layer tube is turned into two single-layer tubes by the adaptor 401, and two single-layer tubes are connected to an interface of a roller shaft 404. An outer side of the housing 402 connects to respective connectors of the hydrate storage tank 2 and the high-pressure pump set 3. As the double-layer tube 403 rotates with the roller 405, hydrates and the seawater change flow paths which is fixed or rotated by a groove on the roller 405.

Figure 5:
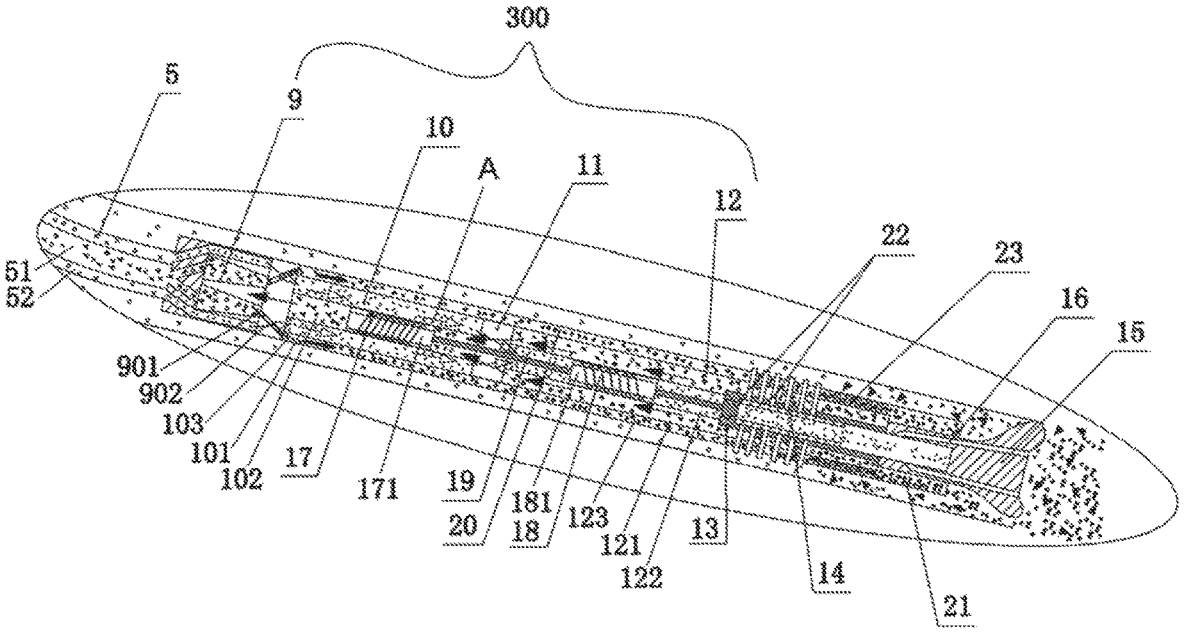
FIG. 5 shows a enlarged view of Part I in FIG. 1.

The seawater with pressure is ejected from the drilling channel 16 of the hydrate drill bit 15 to the sediment cover 6 by successively passing through the hydrate slurry separator 9, the middle channel 101 of the first three-layer tube 10, the internal and external fluid exchange joint of double-layer tube 11, the inner channel 122 of the second three-layer tube 12, the hydraulic motor 18 and an inner cavity of the jet head 13, where a flow direction of the high-pressure seawater is indicated by arrow A in FIG. 5. At the same time, when the high-pressure seawater is injected into the hydraulic motor 18, the output shaft 181 of the hydraulic motor 18 is driven to rotate to drive the input shaft 171 of the single screw pump 17 through the coupling 19 to rotate, while the jet head 13 is driven to rotate to drive the hydrate drill bit 15 to rotate, so that the hydrate drill bit 15 drills into the hydrate reservoir 26. The device is drilled into the hydrate cover by injecting the high-pressure seawater and rotating the hydrate drill bit 15.

1d) The open-hole steering packer 7 is fixed in a well drilled in step 1c, and the recyclable conduit 8 is installed in the open-hole steering packer 7.

1e) Release of recyclable conduit

The continuous double-layer oil pipe 5 is released to disengage from the recyclable conduit 8, with the continuous double-layer oil pipe 5 continuing to drill.

1f) Adjustment of drilling angle

During the drilling of the continuous double-layer oil pipe 5 in the hydrate reservoir 26, the drilling angle of the continuous double-layer oil pipe 5 is adjusted through a deflecting technique, where the recyclable conduit 8 rotates around the open-hole steering packer 7 to assist a deflection of the drilling of the continuous double-layer oil pipe 5 according to a drilling direction in the hydrate reservoir 26, that is, to increase a deflecting angle of the continuous double-layer oil pipe 5 to ensure an effective drilling length of the continuous double-layer oil pipe 5 in a horizontal direction in the shallow hydrate reservoir 26.

1g) Resetting of pressure differential sliding sleeve

The pressure of high-pressure pump set 3 for pumping the sea water is reduced to allow a pressure of the pumped seawater to be lower than a pressure of the seawater from the drilling channel 16, so that the pressure differential sliding sleeve 14 is in an inner end of the jet head 13 to close the jet holes 22.

1h) The hydrate drill bit 15 is driven to continue to drill in the horizontal direction till a pilot hole is completed.

2) Mining of Natural Gas Hydrates

2a) The pressure of high-pressure pump set 3 for pumping the sea water is opened to allow the pressure of the pumped seawater in the jet head 13 to be higher than the pressure of the seawater from the drilling channel 16, so that the pressure differential sliding sleeve 14 is forced to move forward to block the drilling channel 16 and to open the jet holes 22.

2b) Circumferential breaking

Figure 6:
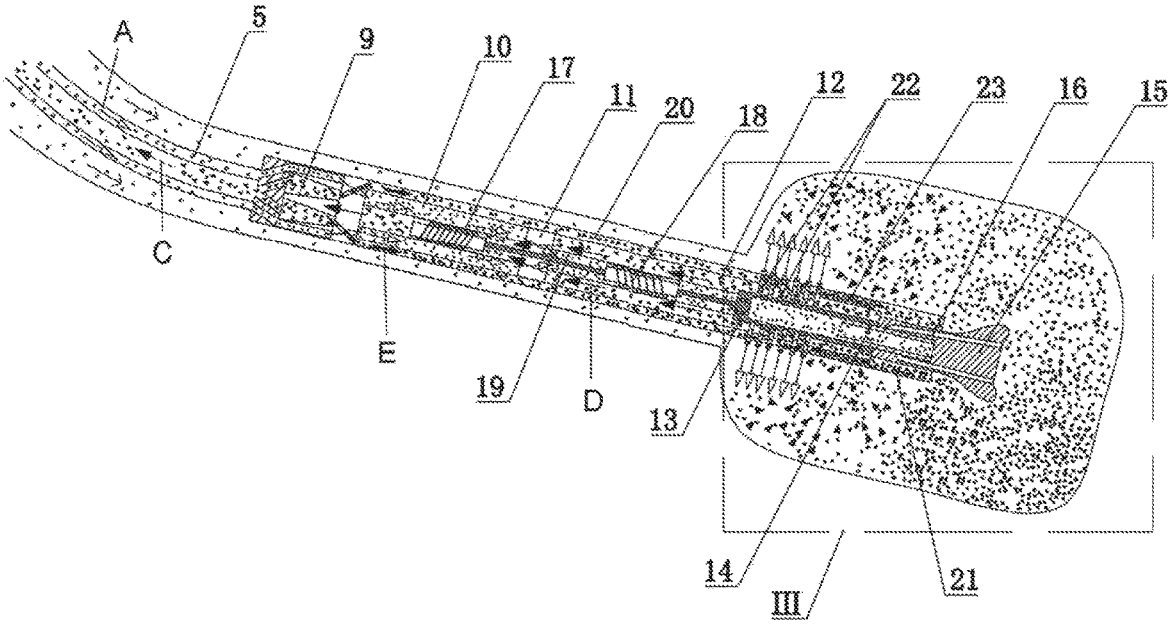
FIG. 6 shows a enlarged view of Part II in FIG. 2.

The high-pressure sea water is ejected from the jet hole 22 in a direction indicated by arrow A in FIG. 6, and the hydrate reservoir 26 is broken in a circumferential direction of the pilot hole to expand the pilot hole in a circumferential direction of the pilot hole, and then a hydrate sediment mixed slurry is obtained.

2c) The continuous double-layer oil pipe 5 is pulled back to break the hydrate reservoir 26 along an axial direction of the pilot hole, and a borehole is gradually expanded along an opposite direction of the drilling with a flow of the high-pressure seawater ejected from the jet head 13.

2d) The single screw pump 17 is driven by the hydraulic motor 18 to allow the hydrate sediment mixed slurry to flow successively through the return port 23, the middle channel 121 of the second three-layer tube 12, the internal and external fluid exchange joint of double-layer tube 11, and the inner channel 102 of the first three-layer tube 10 into the hydrate slurry separator 9 for separation.

Figure 7:
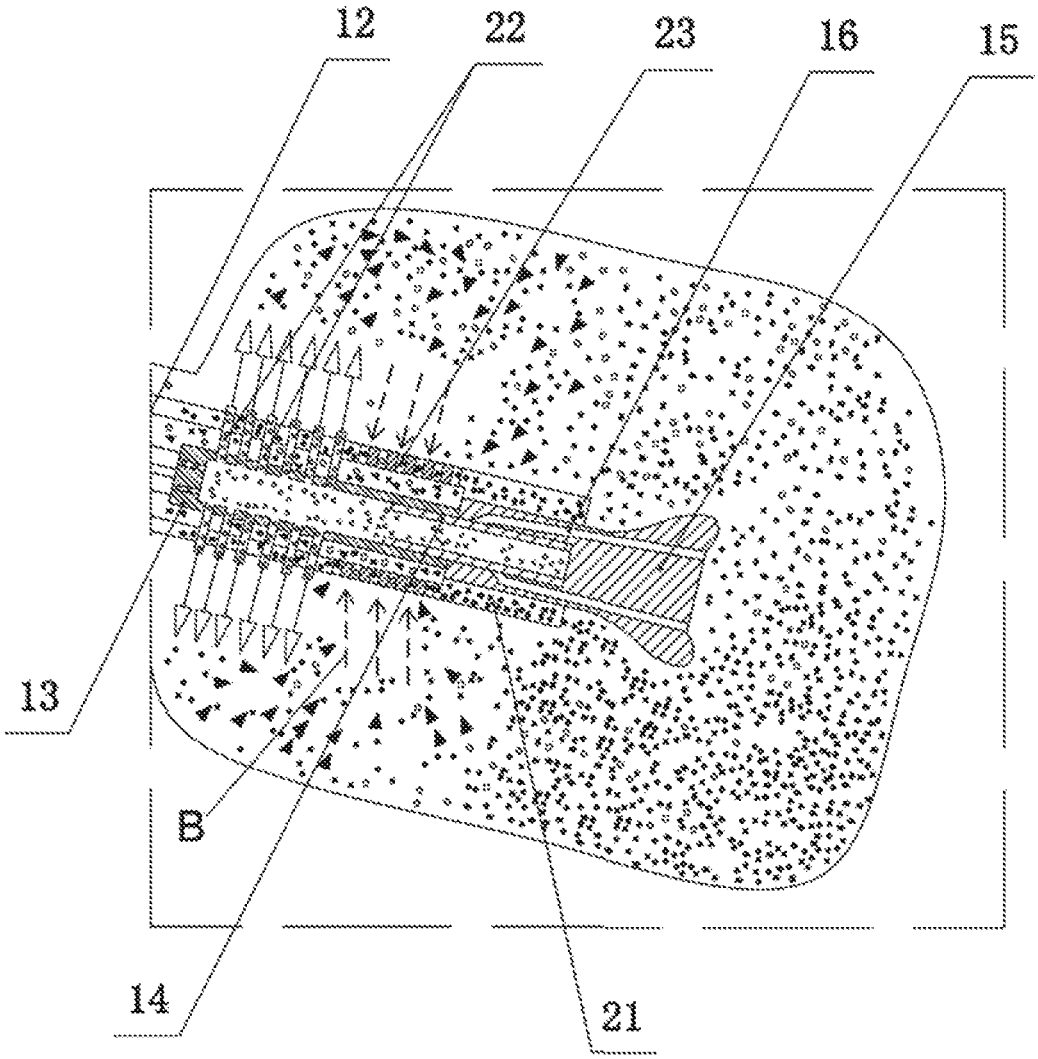
FIG. 7 shows a enlarged view of Part III in FIG. 6.

The hydrate sediment mixing slurry enters the return port 23 in a direction indicated by arrow B shown in FIG. 7, where the solid triangle represents the hydrate; the hollow circle represents the sea water; and the solid circle represents the sediment. The hydrate slurry separator 9 separates the hydrates and the sediment. The separated hydrates are collected into the hydrate storage tank 2 via the inner channel 51 of the continuous double-layer oil pipe 5, where the flow direction of the separated hydrates is indicated by arrow C in FIG. 6. A flow direction of the hydrate sediment mixing slurry is indicated by arrow D in FIG. 6. The separated sediment is discharged into the sediment backfill casing 20 via the sediment outlet 901, and finally into a mined area via the sediment backfilling channel 21, where a flow direction of the separated sediment is indicated by arrow E in FIG. 6.

The hydrates and sediment are separated in-situ, and the sediment is backfilled effectively and settled naturally, reducing the risk of collapse in the goaf, effectively overcoming technical problems of the solid-state fluidized mining for natural gas hydrates in the shallow seabed.

2e) Changing of drilling direction of the device to drill the pilot hole.

After the pulling back, the recyclable conduit 8 is adjusted to rotate around the open-hole steering packer 7 according to the drilling direction, and the deflecting angle is adjusted again to increase a deflecting rate, so that a second pilot hole is drilled according to the drilling process.

2f) Steps 2a-d are repeated to mine the natural gas hydrate at a second site.

2e) Steps 1-2 are repeated to mine the natural gas hydrate around the hydrate collection site.

Therefore, the device and method of the present invention achieves a multi-directionally horizontal drilling and production of hydrate reservoirs in the shallow seabed with a single well head, expanding the drilling area, improving the drilling efficiency and single well production.

3) Recycle of the Device

3a) The continuous double-layer oil pipe 5 is pulled back to a seafloor mud line.

3b) The recyclable conduit 8 is re-hanged to the continuous double-layer oil pipe 5 using an underwater robot.

3c) The open-hole steering packer 7 is unsealed to release the recyclable conduit 8.

3d) The recyclable conduit 8 and the continuous double-layer oil pipe 5 are lifted up to the hydrate drilling vessel 1.

3e) The hydrate drilling vessel 1 is moved to drill the natural gas hydrate at a next hydrate collection site, where the subsea well head device is recyclable for a continuing hydrate mining, reducing costs for equipment.

What is claimed is:

1. A device for solid-state fluidized mining of natural gas hydrates in a shallow seabed, comprising:

a sea surface support system;

a pipeline delivery system; and an undersea drilling system;

wherein the sea surface support system comprises a hydrate drilling vessel floating on seawater, a hydrate storage tank, a high-pressure pump set and a continuous double-layer oil pipe storage device arranged on the hydrate drilling vessel;

the pipeline delivery system comprises a continuous double-layer oil pipe, a recyclable conduit installed in a sediment cover, an open-hole steering packer installed outside the recyclable conduit; the continuous double-layer oil pipe penetrates the recyclable conduit; a head end of the continuous double-layer oil pipe is fixed on the continuous double-layer oil pipe storage device, wherein an inner channel of the continuous double-layer oil pipe is connected to the hydrate storage tank, and an outer channel of the continuous double-layer oil pipe is connected to an outlet port of the high-pressure pump set; and a tail end of the continuous double-layer oil pipe is connected to the undersea drilling system in a hydrate reservoir in the shallow seabed;

the undersea drilling system comprises a hydrate slurry separator, a first three-layer tube, an internal and external fluid exchange joint of double-layer tube and a second three-layer tube, connected successively; via the hydrate slurry separator, the outer channel of the continuous double-layer oil pipe communicates with a middle channel of the first three-layer tube, while the inner channel of the continuous double-layer oil pipe communicates with an inner channel of the first three-layer tube; a channel of the hydrate slurry separator is in communication with an outer channel of the first three-layer tube;

through the internal and external fluid exchange joint of double-layer tube, the middle channel of the first three-layer tube communicates with an inner channel of the second three-layer tube, while the inner channel of the first three-layer tube communicates with a middle channel of the second three-layer tube; the outer channel of the first three-layer tube communicates with an outer channel of the second three-layer tube;

a jet head is arranged in an end of the inner channel of the second three-layer tube; the jet head communicates with the second three-layer tube, and is equipped with a pressure differential sliding sleeve; a hydrate drill bit is fixed at an end of the jet head, and is provided with a seawater ejecting-drilling channel along an axial direction of the hydrate drill bit; and the seawater ejecting-drilling channel communicates with the jet head;

a single screw pump is fixed in the inner channel of the first three-layer tube, and a hydraulic motor is fixed in the inner channel of the second three-layer tube; via a coupling penetrating the internal and external fluid exchange joint of double-layer tube, one end of an output shaft of the hydraulic motor connects to an input shaft of the single screw pump, and the other end of the output shaft is fixedly connected to the jet head; a sediment backfilling casing is equipped outside the undersea drilling system, the sediment backfilling casing is defined as an outer portion of the first three-layer tube, the internal and external fluid exchange joint of double-layer tube and the second three-layer tube; one end of the sediment backfilling casing is connected to a sediment outlet of the channel of the hydrate slurry separator, and the other end of the sediment backfilling casing is arranged with a sediment backfilling channel; a plurality of jet holes communicating with the jet head are provided on a cylindrical surface of the sediment backfilling casing along a circumferential direction of the sediment backfilling casing, and a return port communicating with the outer channel of the second three-layer tube is further provided on the cylindrical surface of the sediment backfilling casing.

2. The device of claim 1, wherein a derrick is further provided on the hydrate drilling vessel.

3. The device of claim 2, wherein a jet head of continuous double-layer oil pipe is provided on the derrick.

4. A mining method using the device for solid-state fluidized mining of natural gas hydrates in the shallow seabed of claim 1, comprising:

1) drilling 1a) driving the hydrate drilling vessel to a hydrate collection site and anchoring the hydrate drilling vessel;

1b) lowering the continuous double-layer oil pipe and the recyclable conduit down to a seabed;

1c) opening the high-pressure pump set and pumping the seawater into the outer channel of the continuous double-layer oil pipe; ejecting the pressurized seawater from the drilling channel of the hydrate drill bit to the sediment cover by successively passing through the hydrate slurry separator, the middle channel of the first three-layer tube, the internal and external fluid exchange joint of double-layer tube, the inner channel of the second three-layer tube, the hydraulic motor and an inner cavity of the jet head; at the same time, when the high-pressure seawater is injected into the hydraulic motor, driving the output shaft of the hydraulic motor to rotate to drive the input shaft of the single screw pump through the coupling to rotate, while driving the jet head to rotate to drive the hydrate drill bit to rotate, so that the hydrate drill bit drills into the hydrate reservoir, drilling into the sediment cover by injecting the high-pressure seawater and rotating the hydrate drill bit;

1d) fixing the open-hole steering packer in a well drilled in step 1c, and installing the recyclable conduit in the open-hole steering packer;

1e) releasing the continuous double-layer oil pipe to disengage from the recyclable conduit, wherein the continuous double-layer oil pipe continues to drill;

1f) adjustment of a drilling angle: during the drilling of the continuous double-layer oil pipe in the hydrate reservoir, adjusting the drilling angle of the continuous double-layer oil pipe via a deflecting technique, wherein the recyclable conduit rotates around the open-hole steering packer to assist a deflection of the drilling of the continuous double-layer oil pipe according to a drilling direction in the hydrate reservoir, that is, to increase a deflecting angle of the continuous double-layer oil pipe to ensure an effective drilling length of the continuous double-layer oil pipe in a horizontal direction in the hydrate reservoir which is shallow;

1g) resetting of the pressure differential sliding sleeve: reducing the pressure of the high-pressure pump set for pumping the seawater to allow a pressure of the pumped seawater to be lower than a pressure of the seawater from the drilling channel, so that the pressure differential sliding sleeve is in an inner end of the jet head to close the jet holes;

1h) driving the hydrate drill bit to continue to drill in a horizontal direction until a pilot hole is completed;

2) mining the natural gas hydrates 2a) opening the pressure differential sliding sleeve:

increasing the pressure of high-pressure pump set for pumping the seawater to allow the pressure of the pumped seawater in the jet head to be higher than the pressure of the seawater from the drilling channel, so that the pressure differential sliding sleeve is forced to move forward to block the drilling channel and to open the jet holes;

2b) circumferential breaking: ejecting the high-pressure seawater from the jet holes; breaking the hydrate reservoir in a circumferential direction of the pilot hole to expand the pilot hole in a circumferential direction, thus obtaining a hydrate sediment mixing slurry;

2c) pulling back the continuous double-layer oil pipe to break the hydrate reservoir along an axial direction of the pilot hole, and gradually expanding a borehole along a direction opposite to drilling direction with high-pressure seawater flow ejected from the jet head;

2d) driving the single screw pump by the hydraulic motor to allow the hydrate sediment mixing slurry to flow successively through the return port, the middle channel of the second three-layer tube, the internal and external fluid exchange joint of double-layer tube, and the inner channel of the first three-layer tube into the hydrate slurry separator for separation, wherein the separated hydrate is collected into the hydrate storage tank via the inner channel of the continuous double-layer oil pipe; the separated sediment is discharged into the sediment backfill casing via the sediment outlet, and finally into a mined area via the sediment backfilling channel;

2e) changing a direction to drill the pilot hole:

after the pulling back, adjusting the recyclable conduit to rotate around the open-hole steering packer according to the drilling direction; adjusting the deflecting angle again to increase a deflecting rate; drilling a second pilot hole according to the drilling process;

2f) repeating steps 2a-d to mine the natural gas hydrate at a second site;

2g) repeating steps 1-2 to mine the natural gas hydrate around the hydrate collection site; and 3) recycle of the device 3a) pulling back the continuous double-layer oil pipe to a seafloor mud line;

3b) re-hanging the recyclable conduit to the continuous double-layer oil pipe using an underwater robot;

3c) unsealing the open-hole steering packer to release the recyclable conduit;

3d) lifting the recyclable conduit and the continuous double-layer oil pipe up to the hydrate drilling vessel; and 3e) moving the hydrate drilling vessel to drill the natural gas hydrate at a next hydrate collection site.

* * * * *